US012442147B2

(12) United States Patent
Hedrington et al.

(10) Patent No.: US 12,442,147 B2
(45) Date of Patent: Oct. 14, 2025

(54) STEERING CONTROL FOR PAVING MACHINE

(71) Applicant: Caterpillar Paving Products Inc., Brooklyn Park, MN (US)

(72) Inventors: Mathew James Hedrington, Ham Lake, MN (US); Jacob Andrew Simmer, Chaska, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 840 days.

(21) Appl. No.: 17/732,195

(22) Filed: Apr. 28, 2022

(65) Prior Publication Data

US 2023/0349108 A1 Nov. 2, 2023

(51) Int. Cl.
*E01C 19/00* (2006.01)
*E01C 19/48* (2006.01)

(52) U.S. Cl.
CPC ..... *E01C 19/004* (2013.01); *E01C 19/48* (2013.01); *E01C 2301/16* (2013.01)

(58) Field of Classification Search
CPC ..... E01C 19/004; E01C 19/48; E01C 2301/16
USPC ..... 404/84.05, 84.8, 118
See application file for complete search history.

(56) References Cited

U.S. PATENT DOCUMENTS

| | | | | |
|---|---|---|---|---|
| 8,888,402 | B2 | 11/2014 | Wirtgen | |
| 8,930,092 | B2 | 1/2015 | Mlnich | |
| 10,435,066 | B2 | 10/2019 | Voegele | |
| 10,458,076 | B2 | 10/2019 | Marsolek et al. | |
| 10,494,772 | B1 | 12/2019 | Boston et al. | |
| 10,633,805 | B2 | 4/2020 | Green et al. | |
| 2016/0334804 | A1* | 11/2016 | Webber | G01S 19/14 |
| 2021/0209870 | A1* | 7/2021 | Thomas | E01C 19/004 |
| 2021/0368696 | A1* | 12/2021 | Friell | E01C 19/20 |

FOREIGN PATENT DOCUMENTS

| | | | | |
|---|---|---|---|---|
| CN | 106835903 | A | 6/2017 | |
| EP | 3611303 | A1 * | 2/2020 | G01C 21/165 |

* cited by examiner

*Primary Examiner* — Raymond W Addie

(57) ABSTRACT

A system adjusts an instantaneous turn center for a paving machine having a tow vehicle and a screed assembly towed by the tow vehicle such that no portion of the screed assembly moves backward over freshly laid pavement when the paving machine paves around a curve. The system receives an input from an operator, a sensor, and/or a database. The input includes a distance and a direction from a first vertical axis defined by a traction device of the tow vehicle on a side of the tow vehicle facing the curve, to a second adjusted vertical axis defined by a point at least as far from the first vertical axis as an outer edge of the screed assembly that touches the curve. The system receives the input, and adjusts the instantaneous turn center for the paving machine to coincide with the second adjusted vertical axis.

20 Claims, 6 Drawing Sheets

STEERING CONTROL FOR PAVING MACHINE

TECHNICAL FIELD

The present disclosure relates generally to a paving machine and, more particularly, to steering control for a paving machine.

BACKGROUND

Paving machines are used to deposit layers of asphalt or other paving materials onto a roadway or parking lot bed. A paving machine generally includes a hopper that receives heated asphalt or other paving materials, a screed, and a conveying system that moves the heated asphalt or other paving material from the hopper onto the bed in front of the screed. During operation, the screed is pushed or pulled over the paving material to level and shape the paving material into a layer having a desired thickness, width, and smoothness. The screed is typically connected to the paving machine via a hinged connection and is allowed to "float" on top of the asphalt and use its weight to level and shape the layer. In some applications, the paving machine is connected to and towed by a dump truck supplying the asphalt or other paving material to the hopper. In other applications, the paving machine includes a tractor or other tow vehicle that self-powers the paving machine.

The thickness and smoothness of the layer of asphalt or other paving material deposited by the paving machine is a function of multiple factors, including the speed of the paving machine and the steering of the paving machine, particularly when traveling around curves. During a paving operation, it can be difficult to maintain a desired thickness and smoothness of the asphalt or other paving material when paving along a curved travel path, such as when paving around a corner, or when entering and leaving a corner. As a result, portions of the bed may be left with imperfections that may be caused by portions of the screed moving back over freshly laid pavement when the paving machine is turning a corner. Such imperfections may include variations in thickness or smoothness of the pavement bed, particularly in areas around curves.

One attempt to monitor the amount of material deposited by a paving machine is disclosed in U.S. Pat. No. 8,930,092 B2 of Minich that issued on Jan. 6, 2015 ("the '092 patent"). Specifically, the '092 patent discloses an asphalt paver having a hopper for storing asphalt, a tractor or other tow vehicle drive system for transporting the hopper, and a variable-width screed attached to the tractor or other tow vehicle drive system. A conveyor transports asphalt from the hopper to the front of the screed via a tunnel, where an auger disperses the asphalt along the width of the screed. The width of the screed is sensed by width sensors attached to left and right sides of the screed. Material height sensors disposed within the tunnel measure the height of the material as it travels from the hopper to the screed, and motion detection devices measure the linear speed of the conveyor. Using a calibration curve, a computer system determines an incremental weight of asphalt being laid down by the paver based on the screed width, material height, and conveyor speed. Using the paver speed (as determined by a speed sensor), the computer system determines an instantaneous amount of paving material or "yield" being applied during the paving process as well as a total yield over period of paving time. The total yield is compared to an actual or "ticket" amount of asphalt delivered by a truck to determine whether all of the delivered asphalt was consumed by the paver.

Although the paver of the '092 patent may allow paver yield to be monitored, it may not be optimum. In particular, the paver of the '092 patent does not provide a means for avoiding imperfections in the thickness or smoothness of the asphalt that may be caused by variations in the leveling and shaping of the deposited asphalt by the screed along sections of travel by the paving machine, particularly when the paving machine is traveling along a curved path.

The disclosed paving machine steering control is directed to overcoming one or more of the problems set forth above and/or other problems of the prior art.

SUMMARY

In one aspect, the present disclosure is directed to a steering system for adjusting an instantaneous turn center for a paving machine having a tow vehicle and a screed assembly towed by the tow vehicle such that no portion of the screed assembly moves backward over freshly laid pavement when the paving machine paves around a curve. The steering system includes an input device configured to receive an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing the curve, to a second adjusted vertical axis defined by a point that is at least as far from the first vertical axis as an outer edge of the screed assembly that touches the curve. A controller connected to the input device receives the input, and implements actions responsive to the input when the paving machine is entering and paving around the curve in order to adjust the instantaneous turn center for the paving machine to coincide with the second adjusted vertical axis.

In another aspect, the present disclosure is directed to a paving machine having a tow vehicle and a screed assembly towed by the tow vehicle. The paving machine includes an input device configured for receiving an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing a curve the paving machine is paving around, to a second adjusted vertical axis defined by a point that is at least as far from the first vertical axis as an outer edge of the screed assembly that touches the curve. A controller connected to the input device receives the input from the input device, and implements actions responsive to the input when the paving machine is entering and paving around the curve in order to adjust an instantaneous turn center for the paving machine to coincide with the second adjusted vertical axis such that no portion of the screed assembly moves backward over freshly laid pavement when the paving machine paves around the curve.

In yet another aspect, the present disclosure is directed to a method of operating a paving machine having a tow vehicle and a screed assembly towed by the tow vehicle such that no portion of the screed assembly moves backward over freshly laid pavement when the paving machine paves around a curve. The method includes receiving an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing a curve the paving machine is paving around, to a second adjusted vertical axis defined by a point that is at least as far from the first vertical axis as an outer edge of the screed assembly that touches the curve. The method further includes implementing actions responsive to the input when the paving machine is entering and paving around the curve in order to adjust an instantaneous turn center for the paving machine to coincide with the second adjusted vertical axis such that no portion of the screed assembly moves backward over freshly laid pavement when the paving machine paves around the curve.

DETAILED DESCRIPTION

Figure 1:
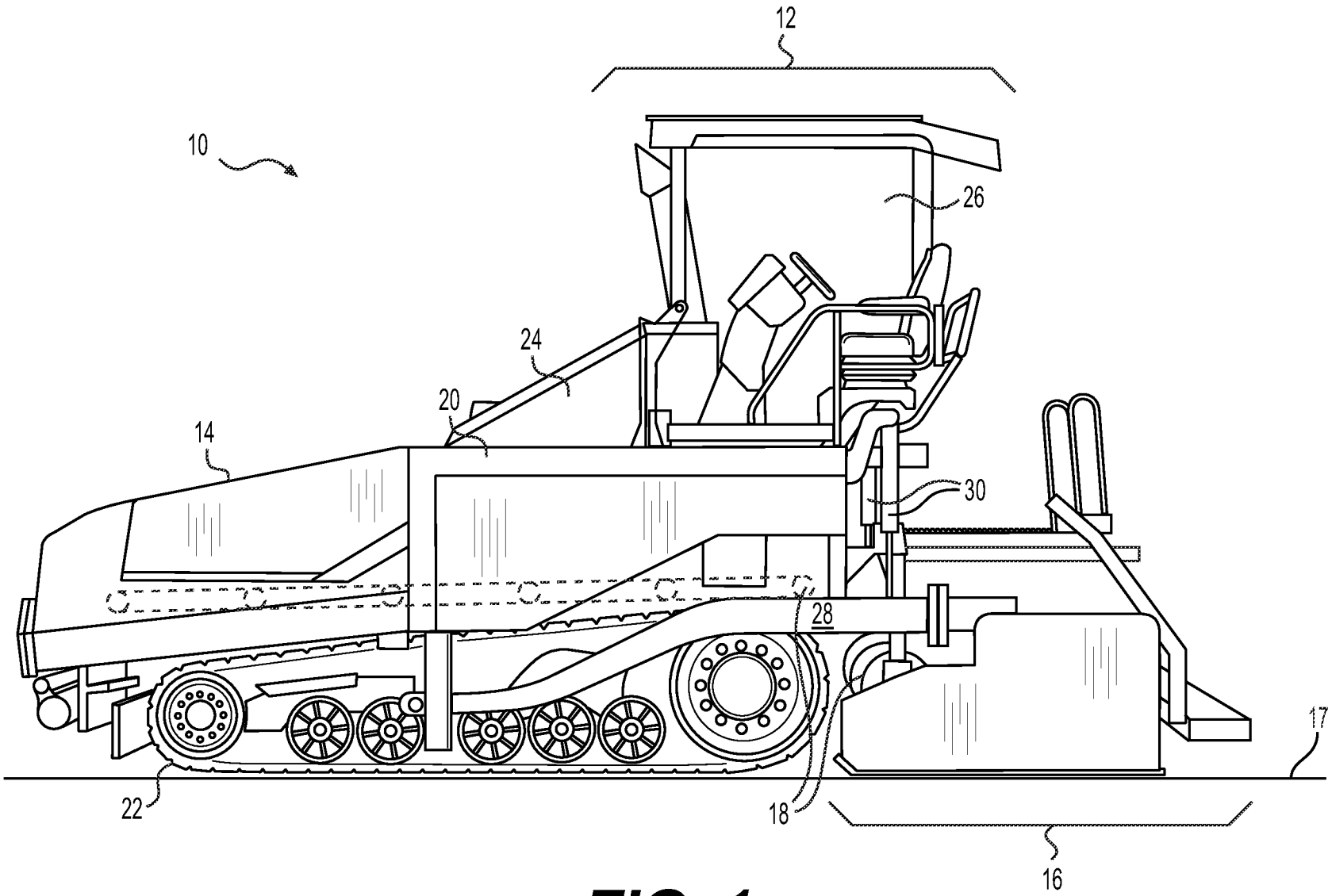
FIG. 1 is a side-view illustration of an exemplary disclosed paving machine.
Figure 2:
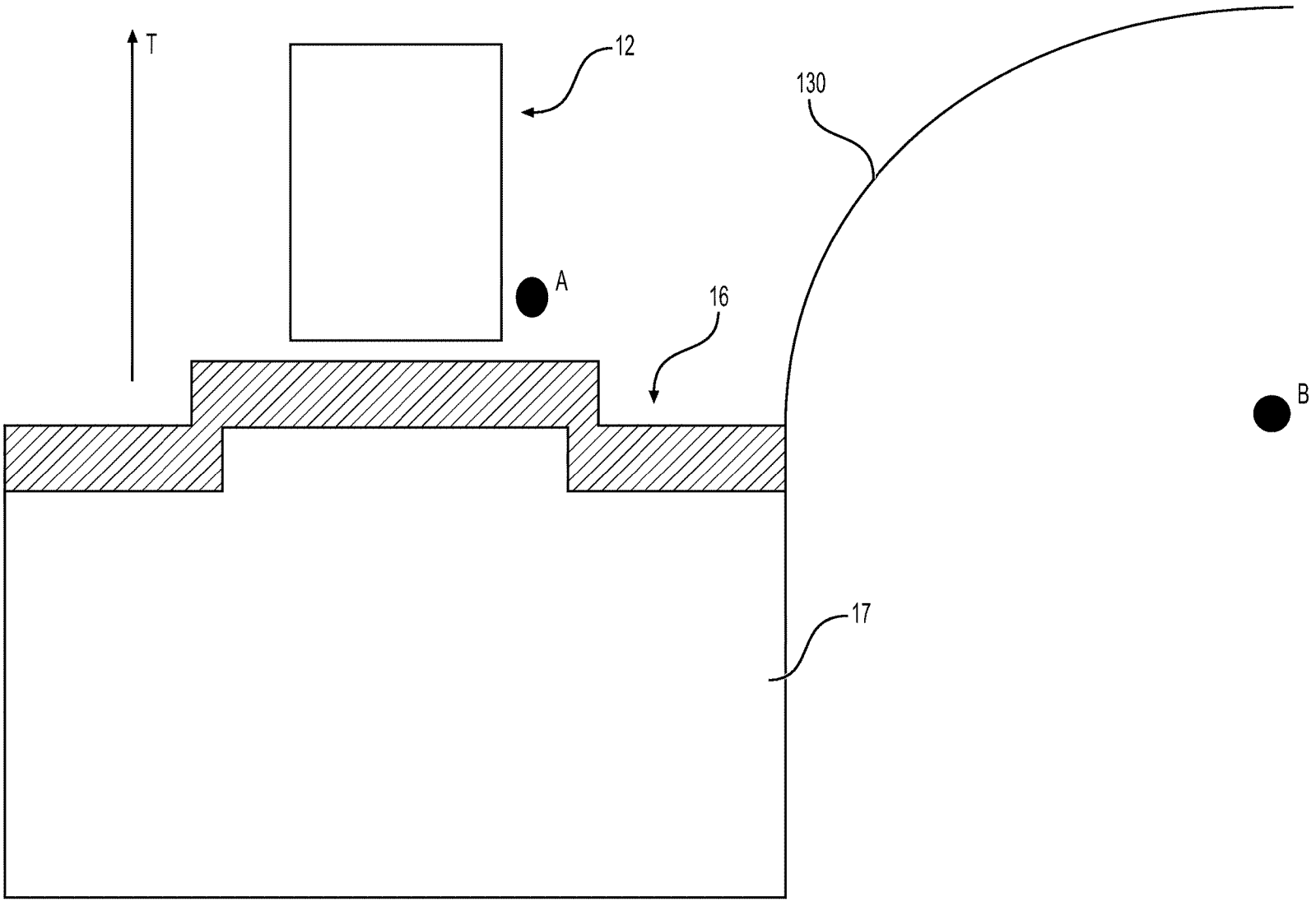
FIG. 2 is a diagrammatic illustration of the tractor or other tow vehicle and screed assembly of the exemplary paving machine of FIG. 1 approaching a curve.

FIG. 1 illustrates an exemplary paving machine 10 having a tractor or other tow vehicle portion 12 carrying a front-mounted hopper 14 and towing a screed assembly 16. A conveying system 18 having belts, chains, and/or augers may be situated to transport paving material (e.g., a hot asphalt mixture) from hopper 14 to screed assembly 16. Screed assembly 16 may then level and shape the material into a layer having a desired thickness and width on top of a work surface 17. In the disclosed example, paving machine 10 is self-powered by way of tractor or other tow vehicle portion 12. It is contemplated, however, that tractor or other tow vehicle portion 12 may alternatively be omitted, and hopper 14 and/or screed assembly 16 towed by another machine (e.g., a dump truck), if desired.

Tractor or other tow vehicle portion 12 may include, among other things, a machine frame 20, a plurality of traction devices 22 (e.g., tracks or wheels—only one shown in FIG. 1) configured to support machine frame 20, a power source (e.g., an engine) 24 configured to drive traction devices 22, and an operator station 26 configured to provide operator control over paving machine 10. Machine frame 20 may support hopper 14, and transmit tractive forces to screed assembly 16 (e.g., by way of tow arms 28—only one shown in FIG. 1). One or more actuators 30 may be connected between machine frame 20 and tow arms 28, and controlled (e.g., for example via operator station 26) to raise, lower, shift, and/or tilt screed assembly 16 relative to machine frame 20. It is also contemplated that screed assembly 16 may generally be free floating, if desired, and only raised or lowered for roading or paving operations, respectively.

As shown, for example, in FIGS. 2-6, screed assembly 16 may be a compilation of components that cooperate to shape, level, and compact the asphalt mixture or other paving material transferred from hopper 14 onto work surface 17 in front of screed assembly 16 by conveying system 18. These components may include a main screed 116 and, in some embodiments, one or more auxiliary screeds 216, 316 that are extendably mounted at opposing ends of main screed 116. Auxiliary screeds 216, 316 may be moved in-and-out relative to main screed 116 by way of one or more hydraulic (or other) actuators, so as to adjust a width of the resulting asphalt layer 17 laid down by screed assembly 16. Auxiliary screeds 216, 316 may be located immediately adjacent main screed 116, in front of main screed 116, or behind main screed 116 relative to a normal forward traveling direction T of paving machine 10. Screed assembly 16 may also include one or more additional screed extensions that are connectable to auxiliary screeds 216, 316 to further increase the width of the resulting asphalt layer 17.

Each of main and auxiliary screeds 116, 216, 316 may include a frame, and the frames of all the screed sections may be operatively connected to machine frame 20 via tow arms 28, as shown in FIG. 1. Main and auxiliary screeds 116, 216, 316 may each include one or more screed plates. A frame of main screed 116 may be connected directly or indirectly to machine frame 20. For example, the frame of main screed 116 may be bolted or welded to tow arms 28, and tow arms 28 may in turn be connected to machine frame 20 by way of actuators 30. When tow arms 28 are connected to machine frame 20 via actuators 30, the operator of paving machine 10 may be able to raise, lower, shift, and/or tilt the frame of main screed 116 to adjust a location and/or operation of main screed 116. Frames of auxiliary screeds 216, 316 may be connected to the frame of main screed 116 and/or to machine frame 20 (e.g., via tow arms 28) via hydraulic (or other) actuators. Additional screed extensions may be mechanically connected to the auxiliary screeds, for example, via bolts or other fasteners, and may also include screed plates.

Main screed 116 may include a right side and a left side that are connected by an actuator, and the left and right sides of main screed 116 may also be pivotally connected at a pivot point. An actuator may be adjusted to rotate the left and right sides about a pivot point to change a position of screed plates and adjust a crown of asphalt layer 17. By their connection to main screed 116, auxiliary screeds 216, 316 and screed extensions may also be tilted and/or extended or retracted when one or more actuators, including the actuator connecting the left and right sides of main screed 116, are extended or retracted, thereby changing the positions of the screed plates of auxiliary screeds 216, 316 and screed extensions.

Auxiliary screeds 216, 316 may be pivotally connected to main screed 116 to allow a grade or slope of asphalt layer 17 to be controlled. For example, a frame of auxiliary screed 216, 316 may be connected to main screed 116 via a pivot point that allows screed plate(s) of auxiliary screeds 216, 316 to be tilted with respect to a screed plate of main screed 116. The frames of auxiliary screeds 216, 316 may also each be connected to main screed 116 by an actuator that is configured to rotate each of the frames of auxiliary screeds 216, 316 about respective pivot points.

In some embodiments, actuators configured for moving frames of auxiliary screeds 216, 316 relative to main screed 116 may each be associated with one or more sensors that are configured to generate signals indicative of a position of a respective one of the actuators. For example, sensors may be cylinder position sensors disposed within each of the actuators. The cylinder position sensors may be configured to generate signals indicative of positions of first ends of each respective actuator with respect to second ends of the respective actuator. In other words, sensors may be configured to generate signals indicative of lengths of the actuators configured to move frames for auxiliary screeds 216, 316.

Figure 3:
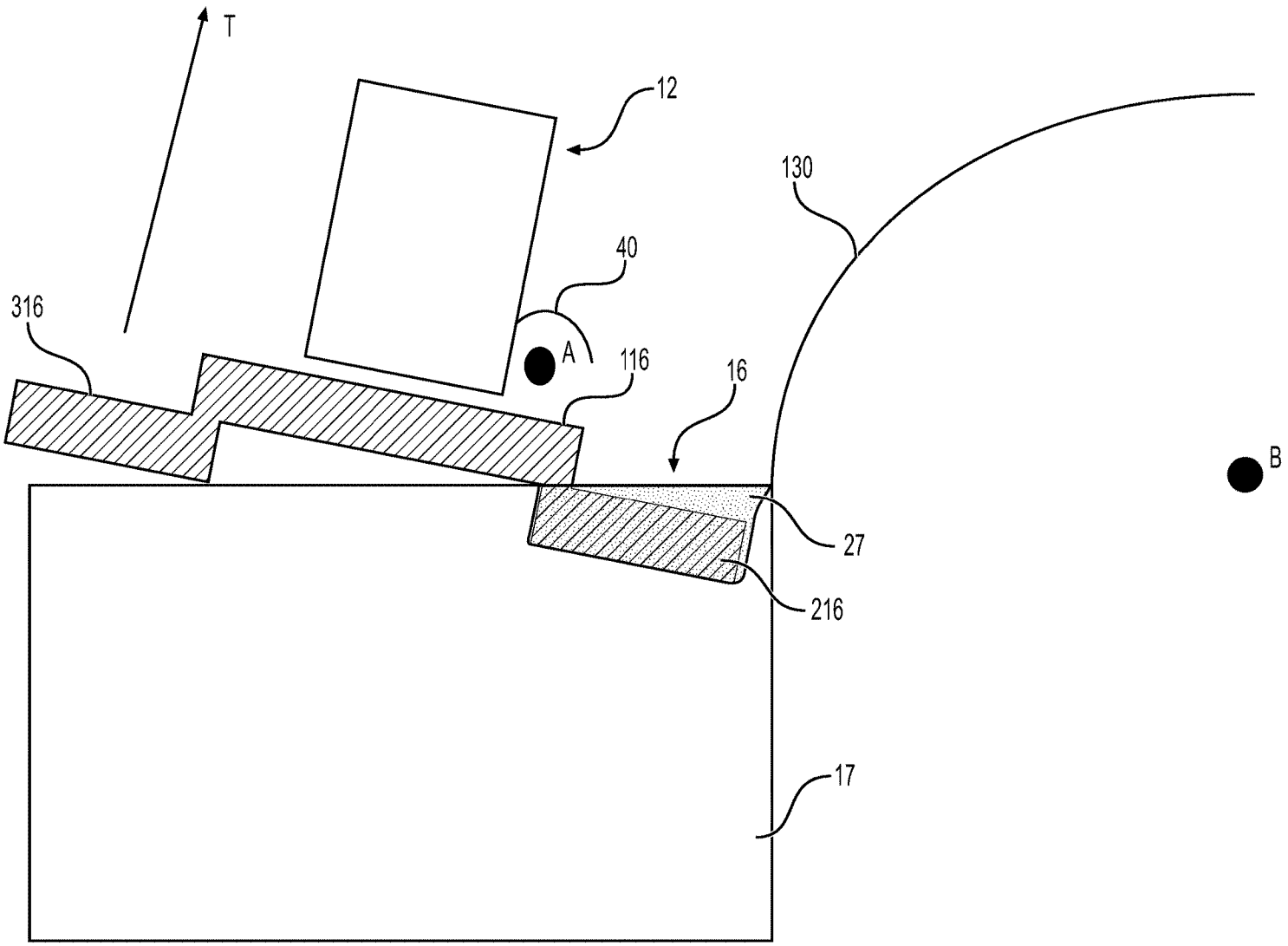
FIG. 3 is a diagrammatic illustration of the tractor or other tow vehicle and screed assembly of FIG. 2 with an instantaneous turn center about a first vertical axis defined through point A located approximately at a contact patch between an inside rear wheel of the tractor or other tow vehicle and the work surface, with a portion of the screed assembly moving backward over a freshly paved area.

As shown in FIGS. 1-4, when a paving machine 10, including tractor or other tow vehicle 12 and screed assembly 16, approaches a curve 130, it may be desirable to lay pavement with screed assembly 16 such that the outer edge of the laid pavement 17 tracks along curve 130 having a curvature defined by at least one radius of curvature at one or more points along the curve, such as a radius of curvature defined around a point B. The curvature of curve 130 can vary continuously or incrementally along its length. As a direction of travel T of paving machine 10 transitions from direction T shown in FIG. 2 to direction T shown in FIG. 3, tractor or other tow vehicle 12 may be steered with a steering radius 40 around a first vertical axis (sometimes referred to as the "yaw" axis) defined through an instantaneous turn center at point A, which may be a vertical axis passing through a contact patch of an inside rear drive wheel (or other traction device) of tractor or other tow vehicle 12 on pavement 17. In some embodiments, tractor or other tow vehicle 12 may be steered by locking the inside rear wheel or track to maintain it in place on the contact patch while operating the outside rear wheel or track such that tractor or other tow vehicle 12 pivots about the first vertical axis defined through A, as shown in FIG. 3. However, the result of steering tractor or other tow vehicle 12 to turn about vertical axis A with a tight steering radius 40 while towing screed assembly 16 behind tractor or other tow vehicle 12 with tow arms 28 may be to cause a portion of screed assembly 16 on the side in the direction of the turn of paving machine 10 to rotate in a backwards direction as shown in FIG. 3, thus possibly causing at least a portion of auxiliary screed 216 on the right-hand side of screed assembly 16 to move backwards over an area 27 of the freshly laid pavement 17, possibly damaging the quality of the surface of the pavement. In other words, if tractor or other tow vehicle 12 is turned with too small of a steering radius, screed assembly 16 supported by tow arms 18 at an axially spaced position behind tractor or other tow vehicle 12 may be rotated such that outside portions of screed assembly 16 may move in a backward direction over freshly laid pavement 17, thus potentially damaging the pavement.

To avoid the scenario shown in FIG. 3, embodiments of a paving machine 10 according to this disclosure may include a steering system for adjusting an instantaneous turn center for paving machine 10, having tractor or other tow vehicle 12 and screed assembly 16 towed by tractor or other tow vehicle 12, such that no portion of screed assembly 16 moves backward over freshly laid pavement 17 when the paving machine 10 paves around a curve 130. The steering system for the paving machine 10 may include an input device configured to receive an input from one or more of an operator of the paving machine, one or more sensors, or a database containing data corresponding to a make and a model of the paving machine. The input may include a distance and a direction from a first vertical axis defined by a traction device of the tow vehicle on a side of the tow vehicle facing the curve (such as a vertical axis through point A in FIGS. 2-5), to a second adjusted vertical axis defined by a point at least as far from the first vertical axis as an outer edge of the screed assembly that touches the curve 130 along which the paving machine will be paving (represented by point A' in FIGS. 4 and 5). In some alternative embodiments of this disclosure, the adjustments to the location of the instantaneous turn center may include locating the second adjusted vertical axis, and hence the new instantaneous turn center when paving around a curve, to a point that is slightly forward, slightly backward, and/or slightly outboard of the outer edge of the screed assembly that touches the curve, provided the end result is that no portion of the screed assembly 16 moves backward over freshly laid pavement when the paving machine paves around the curve. The steering system may include a controller electronically connected to the input device and configured to receive the input, and implement actions responsive to the input when the paving machine is entering and paving around the curve in order to adjust the instantaneous turn center for the paving machine to coincide with the second adjusted vertical axis. One of ordinary skill in the art will recognize that the instantaneous turn center for the paving machine, and the location of the second adjusted vertical axis defined through point A', will be continually changing with time as the paving machine moves with a velocity v in the direction of travel T, and an acceleration $\alpha$ defined at least in part by the centripetal acceleration ($\alpha=v^2/r$), where r equals the instantaneous radius of curvature of the curve 130 at a point in time. The actions implemented by the controller responsive to the input may include controls that implement fully autonomous or semi-autonomous steering of the paving machine, and controls that may place limits on the steering actions an operator can take, as well as controls that provide an operator with specific instructions or warnings designed to prevent steering controls that might result in any portion of screed assembly 16 moving backward over freshly laid pavement 17 when paving machine 10 paves around a curve 130.

Figure 7:
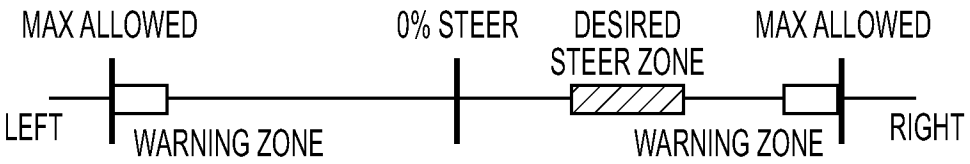
FIG. 7 is a diagrammatic illustration of the maximum amount of steering input that may be provided to the tractor or other tow vehicle while towing the screed assembly around the curve to avoid moving any portion of the screed assembly back over freshly paved surface.

In various exemplary embodiments of this disclosure, the second adjusted vertical axis defined through point A' may fall on any point that is at least as far from the first vertical axis as a point along an outer edge of screed assembly 16 touching the curve, from a point located at or even slightly forward of a front leading corner of the outer edge to a point located at or even slightly rearward of a rear corner of the outer edge relative to a direction of travel T of paving machine 10, and/or a point located outboard of the outer edge of the screed assembly. One of ordinary skill in the art will recognize that the illustrations of the locations of points A and A' in the figures are approximate, for illustration purposes only. In the exemplary embodiment shown in FIGS. 4 and 6, a maximum amount of steering input that may be provided to tractor or other tow vehicle 12 such that the outer edge of screed assembly 16 tracks along curve 130 without any portion of screed assembly 16 rotating backwards over paved area 17, may be defined by a steering radius 42 about the vertical axis passing through point A', or a steering radius 44 about the actual front, outside edge of outer auxiliary screed 216, facing in the direction of travel of paving machine 10. As illustrated in FIG. 7, the controller of the steering system according to various embodiments of this disclosure may be configured to control the steering of tractor or other tow vehicle 12, or in some instances, provide steering commands and warnings regarding oversteering to an operator on tractor or other tow vehicle 12. For example, as shown in FIG. 7, a controller of a steering system for a paving machine according to some embodiments of this disclosure may be configured to provide a display that includes an indication to an operator of a desired steering zone when paving around a right-hand curve or a left-hand curve, along with warning zones and indications of the maximum allowable amount of steering in both left-hand and right-hand turns. As discussed above, the various exemplary implementations of steering control according to this disclosure may result in operation of the paving machine so that the outside edge of an outer auxiliary screed tracks along a constant-radius curve or a curve with variable radii of curvature along its length, provided there is no backward motion of any portion of the auxiliary screed 216 over freshly laid pavement.

Figure 4:
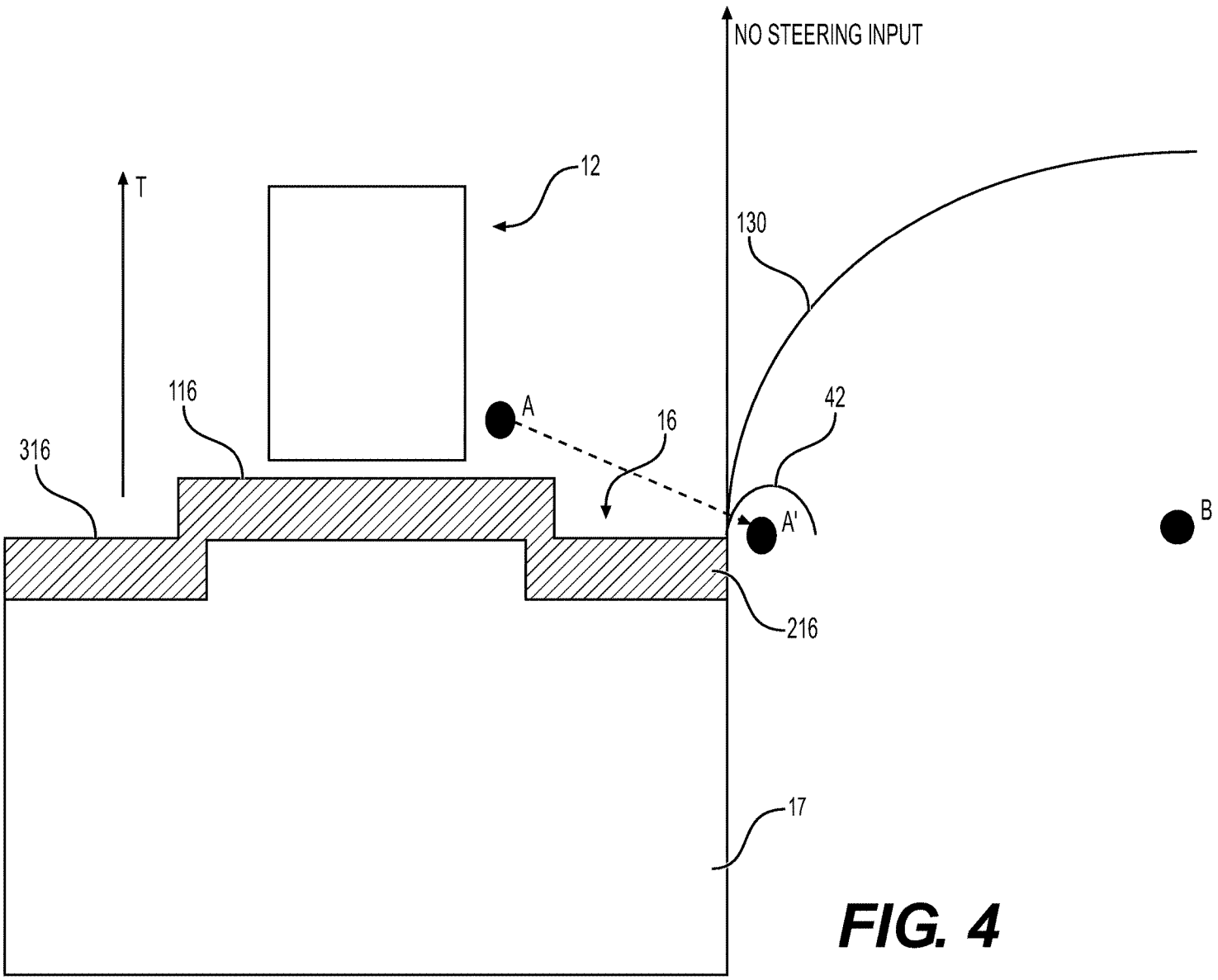
FIG. 4 is a diagrammatic illustration of the tractor or other tow vehicle and screed assembly of FIG. 2, with an instantaneous turn center for the tractor or other tow vehicle and screed assembly entering a curve being moved from a first vertical axis at point A to a second vertical axis defined through a point A' located approximately at a point along an outer edge of the screed assembly touching the curve.
Figure 5:
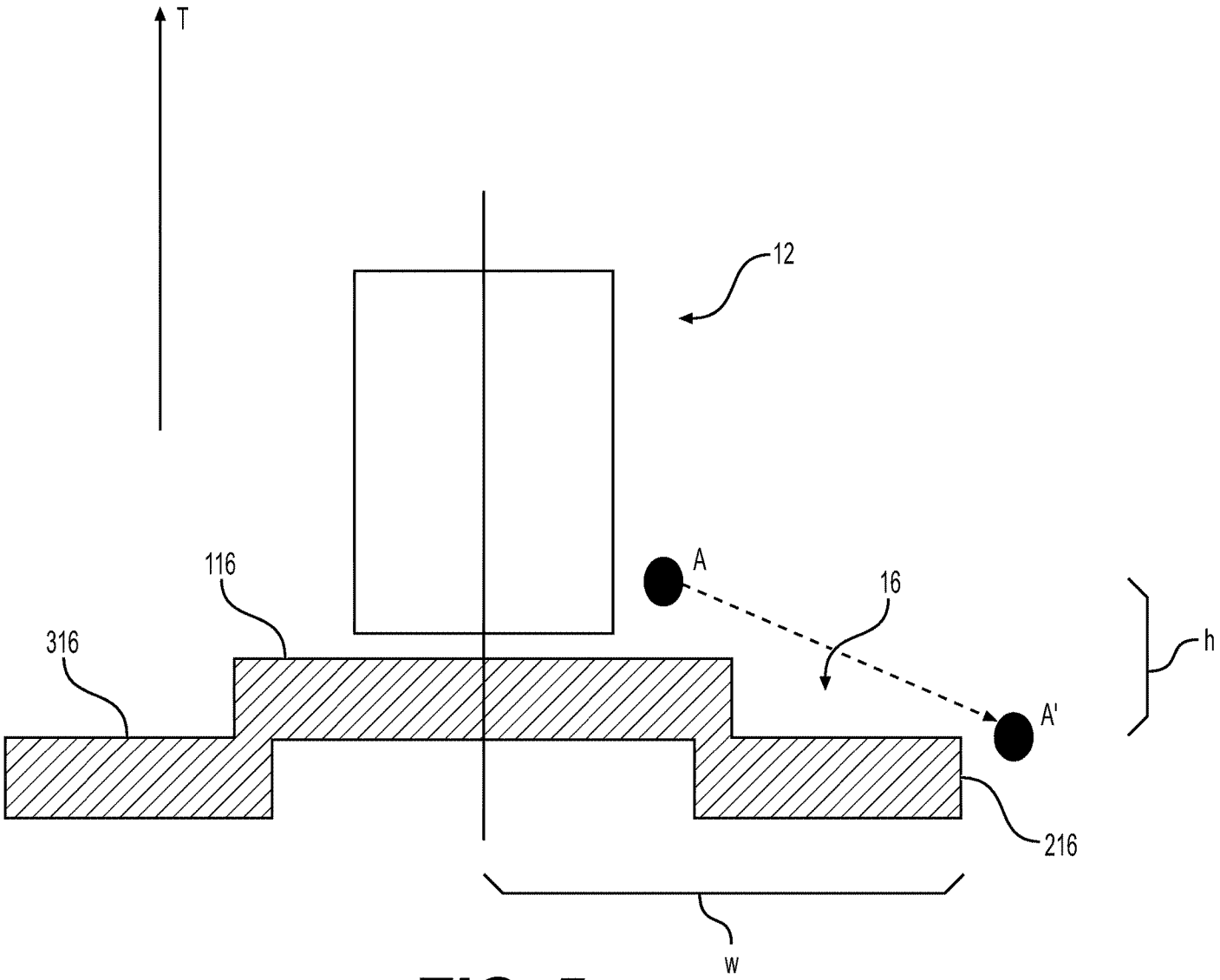
FIG. 5 is a diagrammatic illustration of the tractor or other tow vehicle and screed assembly of FIG. 4, showing the location of the second vertical axis defined through the point A' relative to the first vertical axis defined through point A.
Figure 6:
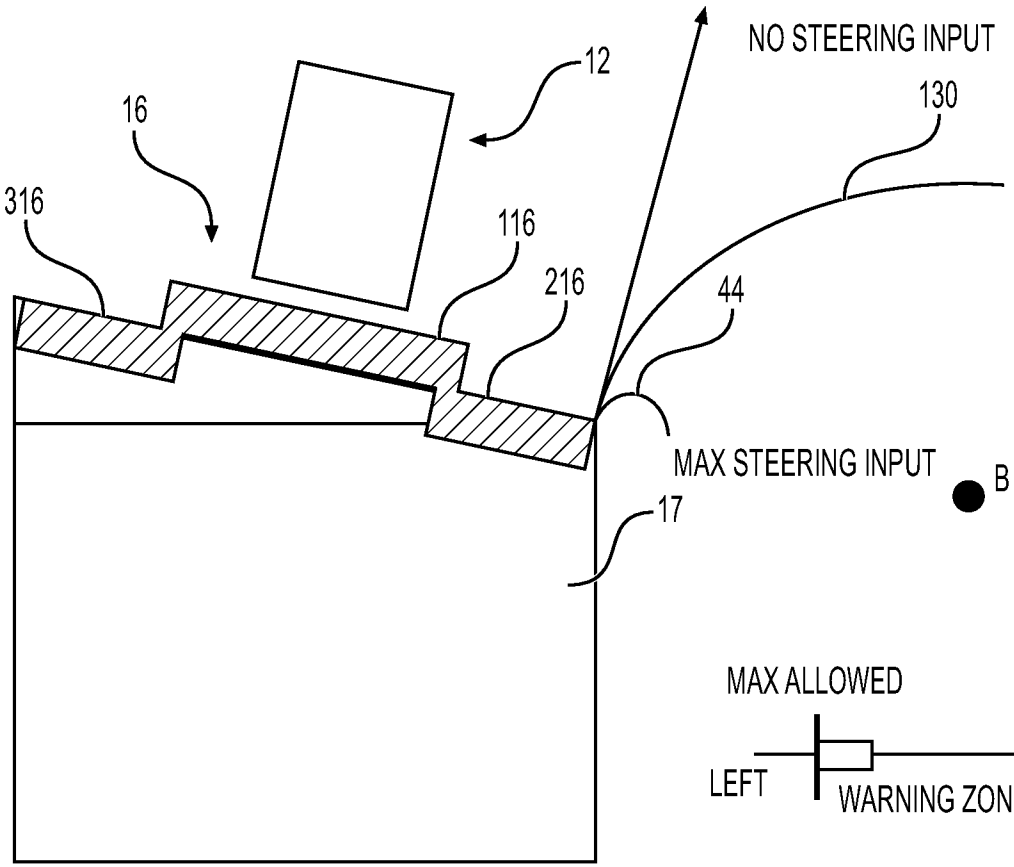
FIG. 6 is a diagrammatic illustration of the tractor or other tow vehicle and screed assembly of FIG. 4 with the outer edge of the screed following the arc of the curve that is being paved.

In some implementations according to this disclosure, the controller of the steering system may be configured to receive the input needed to determine a maximum allowable amount of steering input when operating a paving machine with a tractor or other tow vehicle pulling a screed assembly around a curve. The input may be a manual measurement made by the operator. For example, an operator may simply make a manual measurement of, or may already know from experience, the distance and direction from point A to point A', as shown in FIGS. 4 and 5. As discussed above, the point A' may be defined adjacent the front corner of the outside edge of screed assembly 16 in a direction of travel of the paving machine, or at any other point along the outside edge of screed assembly 16 touching the curve 130. In some implementations, this may coincide with the front, outside corner of the outside edge of auxiliary screed 216 when facing in the direction T of travel of paving machine 10 around curve 130. In other alternative implementations, the controller may be configured to receive the input as an automatic measurement made by one or more sensors including motion transducers, position sensing hydraulic cylinders configured to adjust the width of the screed assembly, cameras or other visual sensors, or lasers or other distance measuring sensors. In still further alternative embodiments, the controller of the steering system may be configured to receive the input from a database for the make and model of the paving machine.

A steering system for a paving machine according to some embodiments of this disclosure may include one or more sensors configured to automatically measure the distance from a vertical axis through one of the wheels or tracks of the tractor or other tow vehicle, such as the rear, inside drive wheel or rear inside drive track of a tractor or other tow vehicle of the paving machine, to a vertical axis defined at a front, outside corner of a screed assembly, or any other point along the outside edge of the screed assembly being towed behind the tractor or other tow vehicle facing in the direction of travel of the paving machine. The one or more sensors may be configured to measure the distance from a central, longitudinal axis through the screed and the tractor or other tow vehicle to the outer edge of the screed in a direction perpendicular to the direction of travel of the paving machine.

A screed assembly according to various embodiments of this disclosure may be configured to be extended to greater widths and retracted to smaller widths as a function of a desired width of pavement being laid by the paving machine. A controller of a steering system for a paving machine according to this disclosure may be further configured to possibly automatically adjust the steering radius of the tractor or other tow vehicle as a function of the width of the screed and the radius of curvature of the curve being paved. The controller of the steering system may be configured to implement actions that result in automatic or manual adjustment of the instantaneous turn center for the tractor or other tow vehicle and screed assembly to be located at the front, right corner of the outer edge (or other point along the right outer edge) of the screed assembly when the paving machine is paving around a curve to the right in a direction of travel of the paving machine. Similarly, the controller of the steering system may be configured to possibly automatically adjust the instantaneous turn center for the tractor or other tow vehicle and screed assembly to be located at the front, left corner of the outer edge (or other point along the left outer edge) of the screed assembly when the paving machine is paving around the curve to the left in a direction of travel of the paving machine.

Various operator interface devices for use with a steering system according to this disclosure may include, among other things, a display and an input device. The operator interface devices may be located at an operator station 26 of paving machine 10 (referring to FIG. 1) or at another location on paving machine 10. In other embodiments, the operator interface device may be offboard paving machine 10. For example, an interface device may embody a remote control, such as a handheld controller, that an operator may use to control paving machine 10 from anywhere on the worksite. The interface device may alternatively embody a software program and user interface for a computer, and may include a combination of hardware and software. In other embodiments, paving machine 10 may be autonomous and may not include an onboard interface device.

A display configured to provide a visual display to an operator, such as shown in FIG. 7, may be configured to render the location of paving machine 10 relative to features of work surface 17 (e.g., paved and/or unpaved parts of work surface 17), and to display data and/or other information to the operator. An input device may be configured to receive one or more inputs, data, and/or instructions from the operator of paving machine 10. For example, an input device may be an analog input device that receives control instructions via one or more buttons, switches, dials, levers, etc. An input device may also or alternatively include digital components, such as one or more soft keys, touch screens, and/or visual displays. Other interface devices (e.g., control devices) may also be possible, and one or more of the interface devices described above could be combined into a single interface device, if desired.

One or more speed sensors may also be associated with one or more traction devices, such as drive wheels or tracks of paving machine 10, and may be configured to generate a signal indicative of a groundspeed of paving machine 10. For example, a speed sensor may be a magnetic pickup-type sensor in communication with a magnet embedded within a rotational component of a drive wheel. A speed sensor may alternatively be associated with a different component of paving machine 10 (e.g., a driveshaft, a transmission, flywheel, etc.), or embody a different type of sensor. In other embodiments, a speed sensor may be a GPS device, Doppler device, or other type of position detecting device capable of generating a signal indicative of the ground speed and/or a distance traveled by paving machine 10.

A communication device onboard paving machine 10 may include hardware and/or software that enables sending and receiving of data messages between a controller of the steering system onboard paving machine 10 and an offboard entity (e.g., a haul truck, a back office computer, a computer network, a paving material plant, etc.). The data messages may be sent and received via a direct data link and/or a wireless communication link, as desired. The direct data link may include an Ethernet connection, a connected area network (CAN), or another data link known in the art. The wireless communications may include satellite, cellular, infrared, WiFi, Bluetooth, and/or any other type of wireless communications that enables the communication device to exchange information between the paving machine 10 and the offboard entity.

The controller of a steering system according to various embodiments of this disclosure may embody a single microprocessor or multiple microprocessors that include a means for monitoring operator and sensory inputs, and determining the radius of curvature (or radii of curvatures) of a curve around which paving machine 10 will be operating to lay pavement. For example, the controller may include a memory, a secondary storage device, a clock, and a processor, such as a central processing unit or any other means for accomplishing a task consistent with the present disclosure. Numerous commercially available microprocessors can be configured to perform the functions of the controller. It should be appreciated that the controller could readily embody a general machine controller capable of controlling numerous other machine functions. Various other known circuits may be associated with the controller, including signal-conditioning circuitry, communication circuitry, and other appropriate circuitry. The controller may be further communicatively coupled with an external computer system, instead of or in addition to including a computer system, as desired.

In some embodiments, a controller of a steering system for a paving machine may be configured to determine the total width of screed assembly 16 based on known dimensions of screed assembly 16 stored within its memory (e.g., known dimensions of main screed 116, auxiliary screeds 216, 316, and any additional screed extensions). In another example, the controller may be configured to determine the total width of screed assembly 16 based on an input from the operator of paving machine 10 via an input device. When screed assembly 16 includes sensors, the controller may be configured to determine the total width of screed assembly 16 based on signals received from the sensors in conjunction with known dimensions stored within its memory and/or dimensions received as inputs from the operator via an input device.

INDUSTRIAL APPLICABILITY

The disclosed steering control system may be applicable to any paving machine where the paving machine will have to lay pavement around curved sections of a work surface. The steering system may prevent an operator from steering the paving machine while paving around a curve with a steering radius that is too tight and that may otherwise result in a portion of the screed assembly being towed by the tractor or other tow vehicle of the paving machine being rotated backwards over freshly laid sections of pavement. The steering system may also monitor the position of screed assembly components in order to improve the accuracy of the calculated instantaneous location of the outer leading edges of the screed assembly such that the screed assembly tracks whatever curve or other boundary it must follow in laying pavement along a work surface.

A method of operating a paving machine having a tow vehicle and a screed assembly towed by the tow vehicle may be implemented according to various embodiments of this disclosure such that no portion of the screed assembly moves backward over freshly laid pavement when the paving machine paves around a curve. The method may include receiving an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing a curve the paving machine is paving around, to a second adjusted vertical axis defined by a point that is at least as far from the first vertical axis as an outer edge of the screed assembly that touches the curve. The method may further include implementing actions responsive to the input when the paving machine is entering and paving around the curve in order to adjust an instantaneous turn center for the paving machine to coincide with the second adjusted vertical axis such that no portion of the screed assembly moves backward over freshly laid pavement when the paving machine paves around the curve.

Several advantages may be associated with the disclosed steering system. For example, because a controller of the steering system may receive and store information on the dimensions of any particular tow vehicle and screed assembly, statistical tabulations and calculations may be performed automatically by the controller, and steering commands may be implemented automatically, or other actions may be implemented, such as clearly displaying steering recommendations to an operator, thus allowing operators to focus on other aspects of the paving operation. Also, because information regarding the dimensional aspects of any particular tow vehicle or screed assembly for a paving machine 10 may be received automatically via communication devices, as described above, operators may not be required to enter delivery information and may be allowed to focus on other aspects of the paving operation. Because a controller of the steering system may determine correction factors based on variables such as changing work surfaces, types of material being laid on a particular job, temperatures, humidity, and other environmental factors, and other relevant and material information received or calculated during the paving process, subsequent calculations of the precise steering rate and radius of curvature for any particular tow vehicle and screed assembly may be more accurate, allowing operators to more accurately identify when and how to adjust paving parameters to satisfy customer specifications.

It will be apparent to those skilled in the art that various modifications and variations can be made to the disclosed steering system for a paving machine. Other embodiments will be apparent to those skilled in the art from consideration of the specification and practice of the disclosed system. It is intended that the specification and examples be considered as exemplary only, with a true scope being indicated by the following claims and their equivalents.

What is claimed is:

1. A steering system for adjusting an instantaneous turn center for a paving machine having a tow vehicle and a screed assembly towed by the tow vehicle such that no portion of the screed assembly moves backward over freshly laid pavement when the paving machine paves around a curve, the steering system comprising:

an input device configured to receive an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing the curve, to a second adjusted vertical axis defined by a point that is located at least as far from the first vertical axis as an outer edge of the screed assembly that touches the curve; and a controller electronically connected to the input device and configured for:

receiving the input, and implementing actions responsive to the input when the paving machine is entering and paving around the curve in order to adjust the instantaneous turn center for the paving machine to coincide with the second adjusted vertical axis.

2. The steering system of claim 1, wherein the controller is configured to receive the input as a manual measurement provided by the operator.

3. The steering system of claim 1, wherein the controller is configured to receive the input from the database having at least one value corresponding to the make and the model of the paving machine.

4. The steering system of claim 1, wherein the controller is configured to receive the input as an automatic measurement made by one or more sensors including motion transducers, position sensing hydraulic cylinders configured to adjust the width of the screed, cameras or other visual sensors, or lasers or other distance measuring sensors.

5. The steering system of claim 4, wherein the one or more sensors are configured to measure a distance from the first vertical axis defined by a traction device at the rear of the tow vehicle on the side of the tow vehicle facing the curve to a paving axis of the screed assembly in the direction of travel of the paving machine.

6. The steering system of claim 4, wherein the one or more sensors are configured to measure a distance from a central, longitudinal axis through the screed assembly and the tow vehicle to the outer edge of the screed assembly that touches the curve in a direction perpendicular to the direction of travel of the paving machine.

7. The steering system of claim 1, wherein the screed assembly is configured to be extended to greater widths and/or retracted to smaller widths as a function of a desired width of pavement being laid by the paving machine, and the controller is further configured to automatically adjust the steering of the tow vehicle as a function of the width of the screed and the curvature of the curve being paved.

8. The steering system of claim 7, wherein the controller is configured to automatically adjust the instantaneous turn center for the tow vehicle and screed assembly to be located at a point along the right outer edge of the screed assembly when the paving machine is paving around the curve to the right in a direction of travel of the paving machine.

9. The steering system of claim 7, wherein the controller is configured to automatically adjust the instantaneous turn center for the tow vehicle and screed assembly to be located at a point along the left outer edge of the screed assembly when the paving machine is paving around the curve to the left in a direction of travel of the paving machine.

10. A paving machine having a tow vehicle and a screed assembly towed by the tow vehicle, the paving machine comprising:

an input device configured for receiving an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing a curve the paving machine is paving around, to a second adjusted vertical axis defined by a point at least as far from the first vertical axis as an outer edge of the screed assembly that touches the curve; and a controller electronically connected to the input device, the controller being configured for:

receiving the input from the input device; and implementing actions responsive to the input when the paving machine is entering and paving around the curve in order to adjust an instantaneous turn center for the paving machine to coincide with the second adjusted vertical axis such that no portion of the screed assembly moves backward over freshly laid pavement when the paving machine paves around the curve.

11. The paving machine of claim 10, wherein the controller is configured to receive the input as a manual measurement provided by the operator.

12. The paving machine of claim 10, wherein the controller is configured to receive the input as an automatic measurement made by one or more sensors including motion transducers, position sensing hydraulic cylinders configured to adjust the width of the screed assembly, cameras or other visual sensors, or lasers or other distance measuring sensors.

13. The paving machine of claim 10, wherein the controller is configured to receive the input from the database having at least one value corresponding to the make and the model of the paving machine.

14. The paving machine of claim 12, wherein the one or more sensors are configured to measure a distance from the first vertical axis defined by a traction device at the rear of the tow vehicle on the side of the tow vehicle facing the curve to a paving axis of the screed assembly in the direction of travel of the paving machine.

15. The paving machine of claim 12, wherein the one or more sensors are configured to measure a distance from a central, longitudinal axis through the screed assembly and the tow vehicle to the outer edge of the screed assembly that touches the curve in a direction perpendicular to the direction of travel of the paving machine.

16. The paving machine of claim 10, wherein the screed assembly is configured to be extended to greater widths and/or retracted to smaller widths as a function of a desired width of pavement being laid by the paving machine, and the controller is further configured to automatically adjust the steering of the tow vehicle as a function of the width of the screed assembly and the radius of curvature of the curve being paved.

17. The paving machine of claim 16, wherein the controller is configured to automatically adjust the instantaneous turn center for the tow vehicle and screed assembly to be located at the front, right corner of the outer edge of the screed assembly when the paving machine is paving around a curve to the right in a direction of travel of the paving machine.

18. The paving machine of claim 16, wherein the controller is configured to automatically adjust the instantaneous turn center for the tow vehicle and screed assembly to be located at the front, left corner of the outer edge of the screed assembly when the paving machine is paving around a curve to the left in a direction of travel of the paving machine.

19. A method of operating a paving machine having a tow vehicle and a screed assembly towed by the tow vehicle such that no portion of the screed assembly moves backward over freshly laid pavement when the paving machine paves around a curve, the method comprising:

receiving an input from one or more of an operator of the paving machine, one or more sensors, or a database containing data corresponding to a make and a model of the paving machine, wherein the input comprises a distance and a direction from a first vertical axis defined by a traction device of the tow vehicle on a side of the tow vehicle facing a curve the paving machine is paving around, to a second adjusted vertical axis defined by a point at least as far from the first vertical axis as an outer edge of the screed assembly that touches the curve; and implementing actions responsive to the input when the paving machine is entering and paving around the curve in order to adjust an instantaneous turn center for the paving machine to coincide with the second adjusted vertical axis such that no portion of the screed assembly moves backward over freshly laid pavement when the paving machine paves around the curve.

20. The method of claim 19, further including:

extending the screed assembly to greater widths and/or retracting the screed assembly to smaller widths as a function of a desired width of pavement being laid by the paving machine; and automatically adjusting the instantaneous turn center of the tow vehicle as a function of the width of the screed assembly and the radius of curvature of the curve being paved.

* * * * *